United States Patent [19]

Wortley et al.

[11] 4,380,493

[45] Apr. 19, 1983

[54] ANODE

[75] Inventors: John P. A. Wortley, Brookwell; John Woolner, Sutton Coldfield, both of England

[73] Assignee: IMI Kynoch Limited, Birmingham, England

[21] Appl. No.: 320,121

[22] Filed: Nov. 10, 1981

[30] Foreign Application Priority Data

Nov. 21, 1980 [GB] United Kingdom ..... 8037450

[51] Int. Cl.[3] ..... C25C 1/10; C25B 11/04; C25B 11/10

[52] U.S. Cl. ..... 204/105 M; 204/286; 204/288; 204/289; 204/290 R; 204/290 F; 204/291; 204/292; 204/293; 204/242

[58] Field of Search ..... 204/105 M, 286, 288, 204/289, 290 R, 290 F, 291-293

[56] References Cited

U.S. PATENT DOCUMENTS 2,766,198 10/1956 Carosella ..... 204/105

FOREIGN PATENT DOCUMENTS 1112085 5/1968 United Kingdom .
1370529 10/1974 United Kingdom .
1434335 5/1976 United Kingdom .

OTHER PUBLICATIONS

Handbook of Chemistry & Physics, 32nd Ed., 1950-51, p. 1808.

*Primary Examiner*—R. L. Andrews
*Attorney, Agent, or Firm*—Cushman, Darby & Cushman

[57] ABSTRACT

A lead anode for electrowinning cells in which the anode is in the form of rods reinforced with a core of titanium or other strengthening material.

11 Claims, 5 Drawing Figures

ANODE

BACKGROUND OF THE INVENTION

This invention relates to anodes and has particular reference to anodes for electrowinning cells. It is well-known to use lead anodes in electrowinning cells and in certain electrowinning cells the anodes are used in the form of thin fingers. This is particularly so in the case of anodes for electrowinning manganese where the anodes need to operate at high current densities. The use of anodes in finger form is described in U.S. Pat. No. 2,766,198 which relates to the use of rod-like lead anodes and in particular the anode comprises the alloy 99% lead 1% silver.

SUMMARY OF THE INVENTION

By the present invention there is provided an anode for an electrowinning cell comprising a plurality of lead or lead alloy rods, characterised in that the rods are reinforced with a core of titanium or of a plastics material inert to the conditions surrounding, in use, the anode, and having a greater tensile strength than the lead or lead alloy of the rods.

The core may be a solid rod or may be tubular or in sheet or mesh form.

The sheet or mesh may be of corrugated section. There may be provided a stabilising bar connected to the bottom of the rods.

The lead or lead alloy may be cast round the core or may be extruded onto the core.

The lead alloy may contain one or more of the alloying elements calcium, silver or antimony. The lead alloy is preferably 1% silver balance lead.

The present invention also provides a method of electrowinning manganese from a solution containing manganese ions comprising inserting an anode and a cathode in the solution and passing an electrical current through the solution to deposit manganese onto the cathode, characterised in that the anode is of the type set out above.

BRIEF DESCRIPTION OF THE DRAWINGS

By way of example embodiments of the present invention will now be described with reference to the accompanying drawings, of which.

DESCRIPTION OF THE PREFERRED EMBODIMENTS

Figure 1:
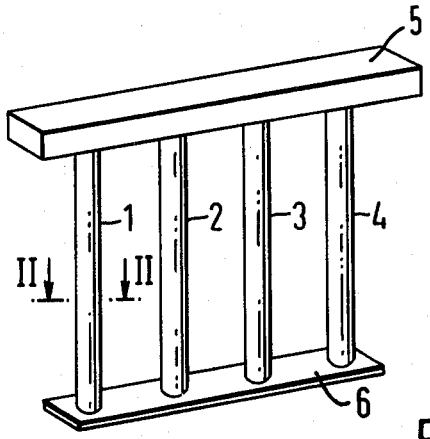
FIG. 1 is a perspective view of a lead anode.
Figure 2:
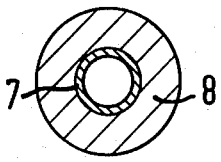
FIG. 2 is a cross-sectional view of FIG. 1 along the line II—II.
Figure 3:
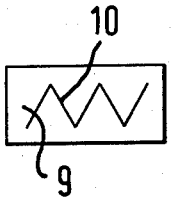
FIG. 3 is a cross-section of an alternative form of rod.

The lead anode comprises a series of rods 1, 2, 3 and 4 connected at their upper ends to a hanger bar 5 in any suitable manner. An optional stabilising bar 6 is connected to the bottom of the rods 1 to 4 to hold them in position. As can be seen more clearly in FIG. 2, each of the rods comprises a central tubular core 7 formed of titanium surrounding which is an alloy of lead 8. The lead rods 9 may be reinforced with titanium mesh 10 as illustrated in FIG. 3.

Figure 4:
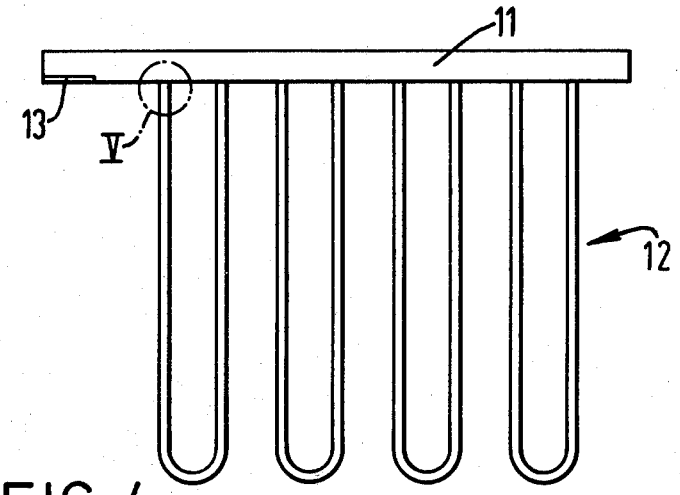
FIG. 4 is a side elevational view of an alternate form of anode.
Figure 5:
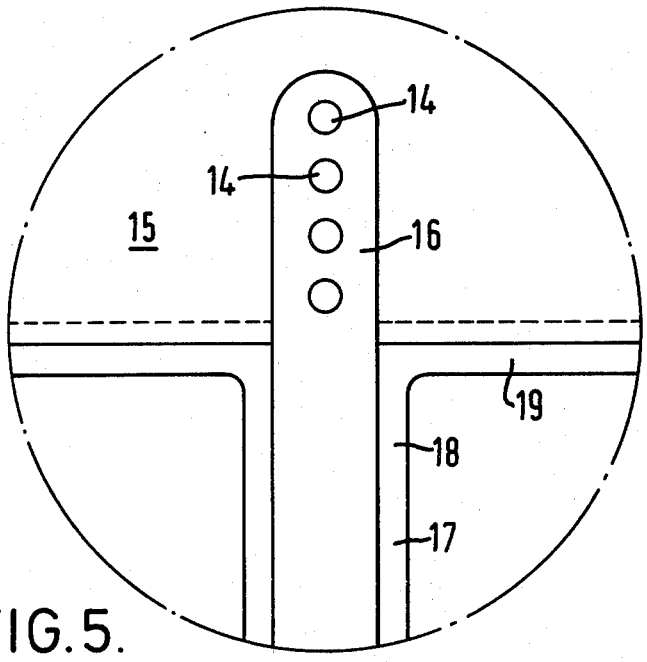
FIG. 5 is an enlarged view of the circled portion V of FIG. 4.

An alternative form of construction is illustrated in FIGS. 4 and 5. In FIG. 4 a hanger bar 11 has attached to it a plurality of reinforced lead rods indicated generally by 12. The hanger bar comprises a copper cored titanium bar in which a portion of the titanium sheath is relieved as at 13 to reveal the copper core. As can be seen more clearly in FIG. 5 the titanium strips are reinforced, the lead rods are spot welded as at 14 to the titanium sheath 15 and these spot welds firmly support the strip 16 which reinforces the rod 17. The lead sheath 18 which forms the anodically active surface of the anode is supported by the strip 16. Ideally the entire hanger bar 11 is also coated with lead as at 19 to protect the assembly from acid splashes.

It can be seen from FIG. 4 that the lead anode rods are in the form of hairpin loops and are suspended simply from the hanger bar assembly.

Dramatic reductions in the loss in anode weight can be obtained by increasing the operating current density at the anode. Thus in a particular example utilising lead 1% silver anodes where the anode current density and the cathode current density was 28A/ft$^2$ the loss in anode weight amounted to 2%. By comparison when the anode current density was increased to 58A/ft$^2$—the cathode current density being maintained at 28A/ft$^2$—the loss in anode weight was reduced to 0.11%. Even more dramatically the loss in silver as a percentage was 2.15% when the anode current density was 28A/ft$^2$ but reduced to 0.07% at an anode current density of 58A/ft$^2$. These tests were carried out in a cell over a period of 30 days and the total amount of manganese plated during the test was 10 344 lb. It can be seen, therefore, that increasing the anode current density has a dramatic effect in reducing the loss of anode material during operation. It also has the effect of reducing the amount of manganese deposited in scale form on the anode from 0.0135 (as a ratio to manganese deposited as metal on the cathode) to a level of 0.0078. Thus the amount of manganese dioxide deposited on the anode is approximately halved.

It appears that the advantages of operating at higher current density relate to the fact that the anode is more likely to evolve oxygen compared to form manganese dioxide. Conventionally the anode compartment is separated from the cathode compartment by a canvas bag and the manganese dioxide formed as a scale on the anode has to be emptied from the canvas bag every 6 to 8 weeks. Thus operating the anode at a higher current density extends the interval between cleaning out of the canvas bag.

It is believed that with current designs many of the failures result from rough mechanical handling during the cleaning operation. However, with conventional anode designs it is not possible to use a smaller surface area for the anode because of the problems of mechanical weakness. Thus the improved anode in accordance with the present invention not only is stronger but is capable of operating at higher current densities (because it can be made thinner) and in these circumstances can operate longer between cleaning operations and also enables a reduction in the anode weight loss per unit of manganese metal plated on the cathode.

The alloy may be a lead-calcium or lead-silver (preferably lead plus 1% silver) or lead-antimony alloy. The anode is used in an electrowinning cell in the conventional manner and because the rods are reinforced they can be thin so that the anode can operate at high current densities. It has been found that operating lead anodes at high current densities leads to improvements in performance of the anodes in terms of their wear rate/Ahr and also electrochemically in manganese electrowinning cells.

We claim:

1. An anode for an electrowinning cell comprising a plurality of lead or lead alloy rods, characterised in that the rods are reinforced with a core of titanium or of a plastics material inert to the conditions surrounding, in use, the anode, and having a greater tensile strength than the lead or lead alloy of the rods.

2. An anode as claimed in claim 1 in which the structure of the core is chosen from the group a solid rod, a tube, a sheet or a mesh.

3. An anode as claimed in claim 2 in which the sheet or mesh is of corrugated section.

4. An anode as claimed in any one of claims 1 to 3 in which there is provided a stabilising bar connected to the bottom of the rods.

5. An anode as claimed in claim 1 in which the lead or lead alloy is cast round the core or is extruded onto the core.

6. An anode as claimed in claim 1 in which the rods are formed of lead containing one or more of the alloying elements calcium, silver or antimony.

7. An anode as claimed in claim 1 in which the rods are connected to a hanger bar and the core of each of the rods is connected to the hanger bar to support the weight of the rod.

8. An anode as claimed in claim 7 in which the core is formed of titanium which is spot welded to a titanium clad copper hanger bar.

9. A method of electrowinning manganese from a solution containing manganese ions comprising inserting an anode and a cathode in the solution and passing an electrical current through the solution to deposit manganese onto the cathode characterised in that the anode is an anode as claimed in claim 1.

10. An anode as in claim 1 wherein the lead or lead alloy has been extruded onto the core.

11. In an electrowinning cell for winning manganese from a solution containing manganese ions, an anode comprising a plurality of lead or lead alloy rods internally reinforced with a core of titanium or of a plastics material inert to the conditions surrounding, in use, the anode, and having a greater tensile strength than the lead or lead alloy of the rods.

* * * * *